US006946880B2

(12) United States Patent
Essenwanger

(10) Patent No.: US 6,946,880 B2
(45) Date of Patent: Sep. 20, 2005

(54) COMPACT BALUN FOR REJECTING COMMON MODE ELECTROMAGNETIC FIELDS

(75) Inventor: Kenneth Alan Essenwanger, Walnut, CA (US)

(73) Assignee: Raytheon Company, Waltham, MA (US)

( * ) Notice: Subject to any disclaimer, the term of this patent is extended or adjusted under 35 U.S.C. 154(b) by 57 days.

(21) Appl. No.: 10/400,956

(22) Filed: Mar. 27, 2003

(65) Prior Publication Data

US 2004/0189419 A1 Sep. 30, 2004

(51) Int. Cl.[7] ..... H01P 5/10

(52) U.S. Cl. ..... 327/26; 327/33

(58) Field of Search ..... 333/22 R, 25, 333/26, 246, 33

(56) References Cited

U.S. PATENT DOCUMENTS 3,784,933 A * 1/1974 Scherer et al. ..... 333/26
4,636,757 A * 1/1987 Harrison et al. ..... 333/218
4,739,519 A 4/1988 Findley
4,882,553 A * 11/1989 Davies et al. ..... 333/26
5,379,006 A 1/1995 McCorkle

FOREIGN PATENT DOCUMENTS

GB 2057196 * 8/1979

OTHER PUBLICATIONS

Kim, Jeong Phil et al. "Novel Configurations of Planar Multilayer Magic–T Using Microstrip–Slotline Transitions," IEEE Trans. on Microwave Theory and Techniques, vol. 50, no. 7, Jul. 2002.

Patent Abstracts of Japan, vol. 009, no. 216 (E–340), Sep. 3, 1985 and JP 60 075101 A (Sony KK), Apr. 27, 1985 abstract; figure 2.

* cited by examiner

*Primary Examiner*—Dinh T. Le
(74) *Attorney, Agent, or Firm*—Leonard A. Alkov; Karl A. Vick

(57) ABSTRACT

A space-efficient broadband balun (20). The balun (20) includes a first mechanism (44, 80, 82, 94, 96) for receiving an input signal (52, 54) having an undesirable component. A second mechanism (50) rejects the undesirable component via a waveguide transition (50). In a specific embodiment, the undesirable component is a common mode component. The first mechanism (44) includes an input microstrip waveguide (44). The waveguide transition (50) is a single microstrip-to-slotline transition (50) from the input microstrip waveguide (44) and to a slotline (32) in a ground plane (34, 36) of the microstrip waveguide (44). The slotline (32) is terminated at a first end (38) via a wedge (40) in the ground plane (34, 46). A second end (42) of the slotline (32) provides an output of the balun (20). The input signal (52, 54) includes a first input signal (52) and a second input signal (54), which are input at opposite ends (38, 42) of the input microstrip waveguide (44). The first input signal (52) and the second input signal (54) have a desired differential mode component and an undesired common mode component.

15 Claims, 3 Drawing Sheets

COMPACT BALUN FOR REJECTING COMMON MODE ELECTROMAGNETIC FIELDS

BACKGROUND OF THE INVENTION

1. Field of Invention

This invention relates to waveguides. Specifically, the present invention relates to baluns for canceling common mode electromagnetic energy in differential input signals or for providing differential output signals lacking common mode energy in response to an input signal.

2. Description of the Related Art

A balun converts unbalanced transmission line inputs into one or more balanced transmission line outputs or visa versa. Baluns are employed in various demanding applications including output stages of delta sigma modulator Direct Digital Synthesizers (ΔΣ DDS) and antenna feeds. Such applications demand miniature, wide-bandwidth (wideband) baluns compatible with integrated circuits and capable of rejecting common mode energy from differential inputs or providing differential outputs lacking common mode energy.

Space-efficient, wideband baluns are particularly important in ΔΣ DDS applications, where dual wideband differential lines must often be converted to a single line output. ΔΣ DDS's are often employed to generate analog output signals with desired amplitudes, frequencies, and phases based on certain digital inputs. ΔΣ DDS's are employed in various applications, including active pulse radar and digital wireless communications, to facilitate signal waveform generation for signal mixing, up-converting, down-converting, frequency synthesis, and signal offsets.

A conventional ΔΣ DDS employs a 1-bit Digital-to-Analog Converter (DAC) to selectively sample an analog input signal to produce a corresponding digital output signal. The DAC must have a relatively high sampling rate to compensate for the low 1-bit resolution quantizer. Consequently, the output of the 1-bit DAC is often a high-frequency pulse-like signal. This 1-bit DAC output is typically filtered to remove quantization noise.

1-bit DACs employed in ΔΣ DDS's often provide dual pulse-like output signals, which are 180 degrees out of phase. These differential pulse-like signals may occur over a wide frequency range and must be converted to a single output via a balun. The 1-bit DAC includes transistors, which often have slightly different rise and fall times. Differences in transistor rise and fall times create undesirable common mode components in pulsed output signals. For optimum DDS performance, these common mode components must be rejected in the final ΔΣ DDS output.

Conventionally, wire-wound ferrite baluns are employed to convert differential input lines into a single balanced output transmission line. These baluns have iron cores wrapped in wire and act as power transformers. Unfortunately, ferrite baluns are bandlimited at lower frequencies, typically cutting off frequencies beyond two or three gigahertz, which is undesirably low for many ΔΣ DDS applications. Furthermore, ferrite baluns are more suitable for continuous wave applications and less suitable for pulse applications, as ferrite baluns are often susceptible to reflections resulting from fast input pulses. To improve balun transient response, the baluns are made larger. The large ferrite baluns are difficult to incorporate into miniature ΔΣ DDS integrated circuits and poorly reject common mode energy.

Alternatively, baluns are constructed using various waveguides having quarter wavelength sections. Unfortunately, use of quarter wavelength sections may result in undesirably large baluns. In addition, these baluns are relatively narrow-banded and are susceptible to large reflections when fed with pulsed inputs.

Hence, a need exists in the art for a miniature wideband balun that is easily incorporated in integrated circuits and that efficiently rejects common mode energy from differential pulsed inputs and provides a balanced output. Such a balun can also provide balanced differential outputs lacking common mode energy from a balanced input. There exists a further need for an efficient ΔΣ DDS that incorporates the efficient wideband balun.

SUMMARY OF THE INVENTION

The need in the art is addressed by the space-efficient broadband balun of the present invention. In the illustrative embodiment, the inventive balun is adapted for use with Direct Digital Synthesizer (DDS) applications. The balun includes a first mechanism for receiving an input signal having an undesirable common mode component. A second mechanism rejects the undesirable common mode component via a waveguide transition.

In a more specific embodiment, the first mechanism includes an input microstrip waveguide. The waveguide transition is a single microstrip-to-slotline transition. The single microstrip-to-slotline transition includes the input microstrip waveguide positioned to cross over a slotline in a ground plane of the microstrip. The slotline is terminated at a first end via a wedge in the ground plane. A second end of the slotline provides an output of the balun.

The input signal includes a first input signal and a second input signal, which are input at opposite ends of the input microstrip waveguide. The first input signal and the second input signal have a desired differential mode component and an undesired common mode component.

In a first alternative embodiment, the first mechanism includes two microstrip waveguides. The input signal includes a first input signal travelling on a first microstrip waveguide and a second input signal travelling on a second microstrip waveguide. The desired signal components of the first and second signal are approximately 180 degrees out of phase. The waveguide transition includes a transition from the first and second microstrip waveguides to a single slotline output waveguide. The slotline output waveguide rejects common mode energy and passes differential mode energy corresponding to the desired signal components. The transition further includes a first transition from the first microstrip line to a first slotline section and a second transition from the second microstrip line and a second slotline section. The transition also includes a coplanar waveguide section fed via the first slotline section and the second slotline section and a transition from the coplanar waveguide section to an third slotline section corresponding to the slotline output waveguide. The first, second, and third slotline sections and the coplanar waveguide section are implemented in a ground plane associated with the first and second microstrip waveguides.

In a second alternative embodiment, the first mechanism includes first and second coaxial waveguides. The waveguide transition includes a dual coax-to-coplanar waveguide-to-single coax transition. A resistor network or bridge in the waveguide transition facilitates load matching and attenuates back-reflected common mode energy.

The novel design of the present invention is facilitated by use of an efficient waveguide transition to reject undesirable components from an input signal. By transitioning from an unbalanced line to a balanced line, undesirable common mode components are efficiently rejected. This results in a compact broadband balun suitable for various high-frequency applications, such as ΔΣ DDS applications.

DESCRIPTION OF THE INVENTION

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
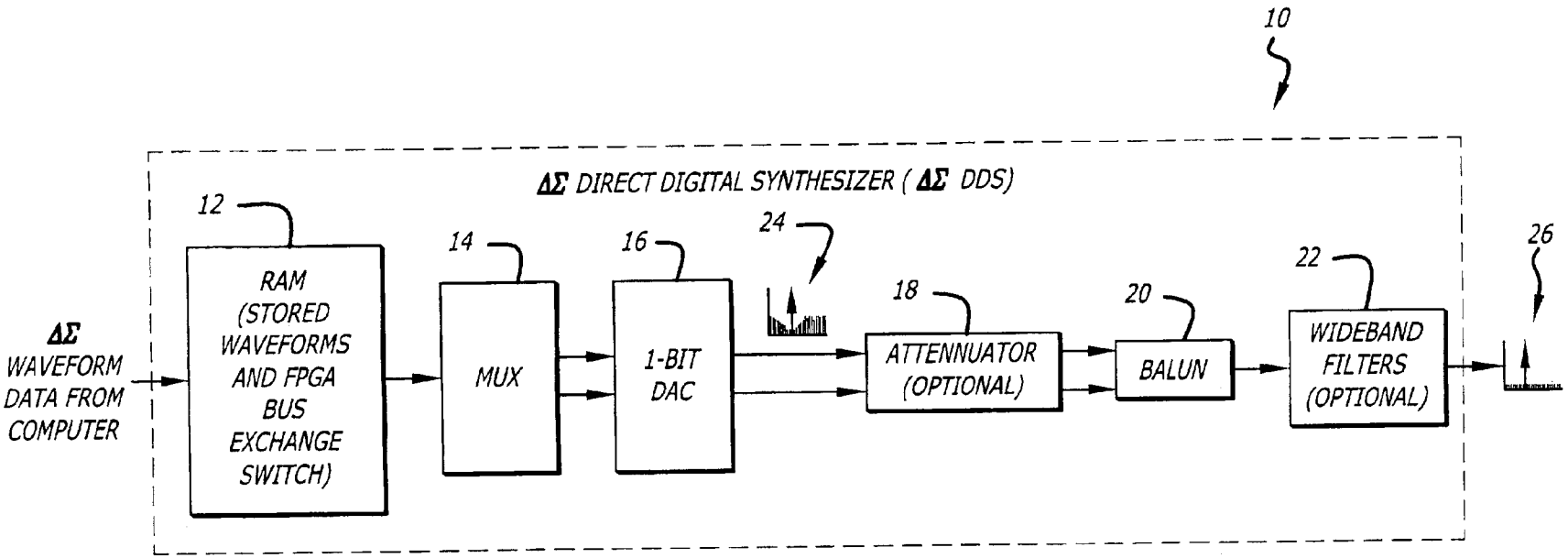
FIG. 1 is a diagram of a ΔΣ DDS employing a unique broadband balun and constructed in accordance with the teachings of the present invention.

FIG. 1 is a diagram of a ΔΣ DDS 10 employing a compact broadband balun 20 that is constructed in accordance with the teachings of the present invention. For clarity, various well-known components, such as power supplies, clocking circuitry, software feedback loops, and so on, have been omitted from the figures. However, those skilled in the art with access to the present teachings will know which components to implement and how to implement them to meet the needs of a given application.

The ΔΣ DDS 10 includes, from left to right, a Random Access Memory (RAM) 12, a Multiplexer (MUX) 14, a 1-bit Digital-to-Analog Converter (DAC) 16, an attenuator 18, and the broadband balun 20 and an optional set of wideband filters 22 that is connected at the output of the balun 20. The various components 12–22 are connected in series. The ΔΣ DDS 10 is a feed-forward system.

In operation, the ΔΣ DDS 10 outputs a desired waveform based on data stored in the RAM 12. ΔΣ DDS 10 may be used for various applications including waveform generation for fine frequency synthesis or for offset frequency generation.

Parameters specifying desired waveform characteristics, such as amplitude and frequency, are written to the RAM via a computer or other processor (not shown). The RAM incorporates a Field-Programmable Gate Array (FPGA) bus exchange switch for facilitating timing and control.

Digital waveform data is selectively input to the MUX 14 from the RAM 12 in response to control signaling from a computer or processor (not shown). The output of the RAM 12 is often a bus, such as a 32-bit bus. Each output bit is converted to a differential signal pair at the input of the MUX 14 via methods known in the art. The MUX 14 then provides a differential output signal on two conductors. The differential output signal represents a stream of single bits.

The 1-bit differential output signal from the MUX 14 is input to the 1-bit DAC 16. The 1-bit DAC 16 employs a 1-bit quantizer and a high sampling rate to compensate for the low resolution of the 1-bit quantizer. In many communications and radar applications, the output of the 1-bit DAC 16 will be a high-frequency, multi-GHz, pulsed signal that has excess quantization noise as represented by the spectrum 24. In addition, naturally occurring differences in rise and fall times of various transistors in the 1-bit DAC 16 and MUX 14 cause an undesirable common mode component in the differential outputs of the 1-bit DAC 16. The outputs of the 1-bit DAC 16 are often provided via microstrip transmission lines, dual slotlines, a coplanar waveguide, or coaxial cables.

Ideally, signals on the differential output microstrip lines are exactly 180° out of phase. When the signals are not 180° out of phase, an undesirable common mode component exists. The balun 20 removes this undesirable common mode component and provides a single output based on the differential inputs. The common mode component is often called the even mode component. The desired differential mode component is often called the odd mode component.

For the purposes of the present discussion, a balun is a device that converts a balanced signal to an unbalanced signal or visa versa. Dual-conductor transmission lines are inherently balanced, while three-conductor transmission lines are potentially unbalanced.

The balun 20 employs a unique transition from unbalanced microstrip transmission line (3 conductors) to a balanced transmission line (two conductors) to reject the undesirable common mode component from the output of the 1-bit DAC 16. Any common mode energy that is not dissipated via the balun 20, and is reflected back, is absorbed via the optional attenuator 18. The attenuator 18 may be implemented as a pi (π) attenuator.

The output of the balun 20 is then provided to a filter 22, which facilitate removal of noise, such as quantization noise, from the output of the balun 20. The output of the filter 22 represents the desired spectrum 26, which is similar to the spectrum 24 but with undesirable signal components and noise removed via the balun 20 and the filter 22. In some applications, the balun 20 and filter 22 may be replaced by a suitable active filter. However, active filters may introduce prohibitive distortion and phase noise for some applications.

The input to the balun 20 may be back-terminated so that energy reflected from the balun transition dissipates in the resistors of the back termination. In this case, the attenuator 18 may be omitted. Alternatively, the balun 20 may incorporate a load matching resistor network to dissipate reflected energy, as discussed more fully below.

Use of differential signals in the MUX 14 and 1-bit DAC 16 may reduce phase noise and pulse distortion, and may improve settling time and the Signal-to-Noise Ratio (SNR) of the ΔΣ DDS 10. Use of the balun 20 to reject common mode energy increases the SNR of the ΔΣ DDS 10.

Conventional baluns are often too large to be efficiently integrated in the ΔΣ DDS 10 chip and are often undesirably band-limited by interwinding capacitance. The balun 20 of the present invention is suitable for chip-level integration is readily implemented in GaAs and other integrated circuit chip environments.

This feed-forward ΔΣ DDS 10 eliminates stability issues associated with conventional ΔΣ DDS hardware and feedback loops. ΔΣ modulator feedback loops (not shown) employed by the ΔΣ DDS 10 reside in the software (not shown) running on the computer that generates the waveform parameters that are input to the RAM 12. The computer can simulate high-order ΔΣ modulators while maintaining loop stability.

Figure 2:
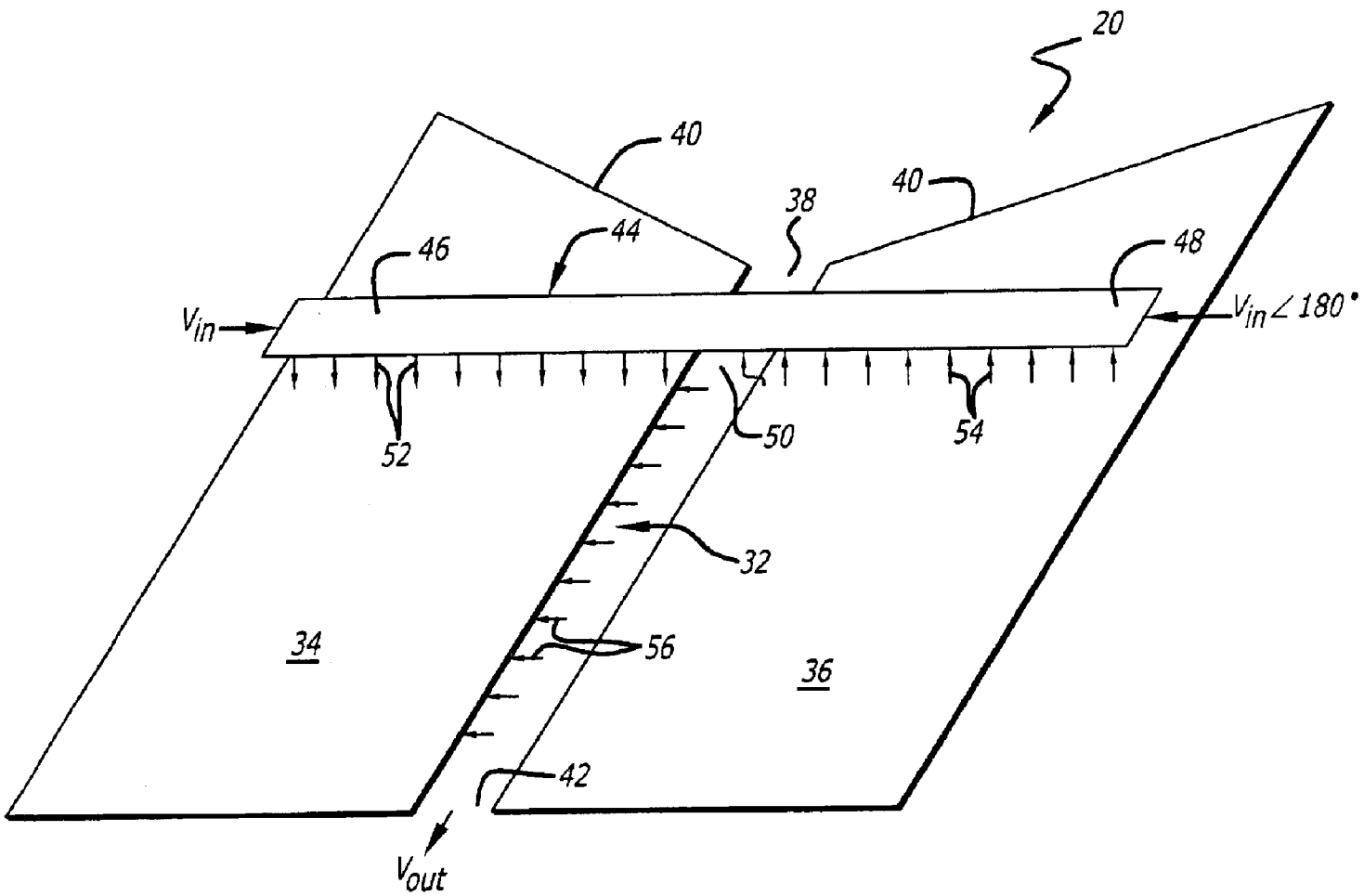
FIG. 2 is a more detailed perspective view of the balun of FIG. 1.

FIG. 2 is a more detailed perspective view of the balun 20 of FIG. 1. The balun 20 includes a slotline waveguide 32 formed between a first groundplane section 34 and a second groundplane section 36. The slotline waveguide 32 includes an open end 38 and an output end 42. The open end 38 opens into a V-shaped cut-away or wedge in the groundplane sections 34 and 36, which is formed by angled groundplane edges 40.

A microstrip waveguide 44 passes perpendicularly to the slotline 32 over the ground plane sections 34 and 36. The microstrip 44 includes a first microstrip section 46, which is supported by the first ground plane section 34, and a second microstrip section 48, which is supported by the second groundplane section 36. For clarity, the dielectric between the microstrip 44 and the ground plane sections 34, 36 is not shown. Various high-dielectric constant materials, such as alumina, may be employed. Those skilled in the art will know which dielectric material to use to meet the needs of a given application. The ground planes sections 34 and 36 and the microstrip 44 are implemented via copper or gold conductors. The dimensions of the ground planes sections 34 and 36 and the microstrip 44 are application-specific and may be determined by one skilled in the art with access to the present teachings to meet the needs of a given application.

The microstrip 50 passes over the slotline 32 at a microstrip-to-slotline transition 50. The different microstrip sections 46 and 48 may be considered as different microstrip lines that are separated by the microstrip-to-slotline transition 50.

In operation, the ends of the microstrip 44 are fed with differential input signals 52 and 54 at opposite ends 46 and 48, respectively. Exemplary electric field lines associated with the differential input signals 52 and 54 are shown. The differential input signals 52 and 54, which are also called anti-phase signals, are approximately 180 degrees out of phase. Any common mode components, such as components that are in-phase, are rejected at the microstrip-to-slotline transition 50. Any energy that is reflected back from the transition 50 is attenuated in the attenuator 18 of FIG. 1.

The balun 20 introduces 90-degrees of phase rotation in each slotline leg 46 and 48 to facilitate canceling common mode energy components and passing differential mode electromagnetic energy components. Baluns that employ quarter wavelength sections or employ 180-degrees of rotation in different balun legs are often large and not physically symmetric, which can lead to poor performance. Baluns 20 and 20' of the present invention are physically symmetric.

The desired odd mode or differential mode component 56 is coupled to the slotline 32, which is a balanced transmission line. The differential mode component 56 that remains on the balanced slotline 32 is necessarily balanced due to the balanced nature of the slotline 32 and lacks undesirable common mode energy components.

Although the design of the balun 20 appears structurally simple, it has significant advantages when used as a balun. The balun 20 exhibits broadband performance from multi-megahertz to multi-gigaHertz frequencies and efficiently accommodates pulsed waveforms. Furthermore, the balun 20 is readily miniaturized and incorporated into integrated circuits. Unlike many conventional baluns, which may rely on quarter wavelength sections, the performance of the balun 20 is less size-dependent. Excellent broadband performance may be achieved with a miniature balun constructed in accordance with the teachings of the present invention.

Those skilled in the art will appreciate that the balun 20 of the present invention is not limited to DDS applications. The present invention may be adapted to any application requiring a compact wideband balun that rejects common mode energy from differential input signals. Furthermore, the balun 20 may be fed in reverse, providing differential output signals lacking common mode energy from a signal input at the slotline end 42. Hence, the balun 20 may be employed to convert one input signal into a differential output signal pair. Such a balun, for example, may be employed to convert the balun's slotline output back into a differential signal for a fully differential implementation of the filter 22 of FIG. 1.

Various pads, impedance transformers, tapered lines, and other impedance matching techniques may be adapted to the balun 20 without departing from the scope of the present invention. Various conventional techniques and features not disclosed may also be employed to further lower the cutoff frequency of the balun 20, which is already low enough for DDS synthesized bandwidth in the delta-sigma DDS application 10 of FIG. 1.

Figure 3:
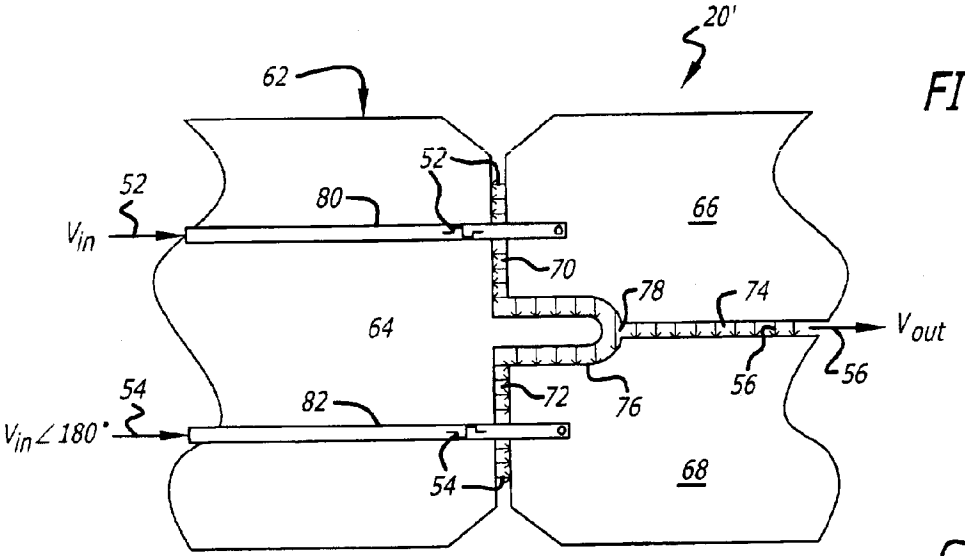
FIG. 3 is a more detailed perspective view of a first alternative embodiment of the balun of FIG. 2.

FIG. 3 is a more detailed perspective view of a first alternative embodiment 20' of the balun 20 of FIG. 2. The alternative balun 20' includes a groundplane 62 having a first groundplane section 64, a second groundplane section 66, and a third groundplane section 68. The groundplane sections 64, 66, and 68 are positioned to form a first slotline section 70 between the first groundplane section 64 and the second groundplane section 66. A second slotline section 72 is formed between the first groundplane section 64 and the third groundplane section 68. A third slotline section 74 is formed between the second groundplane section 66 and the third groundplane section 68.

A coplanar waveguide section 76 interfaces the first slotline section 70 and the second slotline section 72 with the third slotline section 74 and is positioned between the three groundplane sections 64, 66, and 68. A coplanar waveguide-to-slotline transition 78 exists at one end of the coplanar waveguide section 76 and acts as a transition between the coplanar waveguide 76 and the third slotline section 74. Different legs of the coplanar waveguide section 76 originate from the different slotline sections 70 and 72. The coplanar waveguide section 76 may be omitted, leaving only a slotline T-junction, without departing from the scope of the present invention.

A first microstrip waveguide 80 passes over the first slotline section 70 approximately perpendicular to the first slotline section 70 and is terminated via a first electrical connection 84 to the second groundplane section 66. Similarly, a second microstrip waveguide 82 passes over the first slotline section 70 approximately perpendicular to the first slotline section 70 and is terminated via a second electrical connection 86 to the third groundplane section 68.

In operation, differential input signals 52 and 54, which are 180-degrees out of phase, are input via the first microstrip section 80 and the second microstrip section 82, respectively. The differential input signals 52 and 54 couple to the corresponding slotline sections 70 and 72, respectively, at transitions between the microstrips 80 and 82 and the slotline sections 70 and 72, respectively.

Approximations to electric field lines associated with the first input signal 52 and the second input signal 54 are shown in the various sections 70–78 of the balun 20'. Opposite ends of the slotline sections 70 and 72 are open-ended so that electromagnetic energy 52 and 54 fed to the slotline sections 70 and 72, respectively, flows toward the coplanar waveguide section 76; through the coplanar waveguide-to-slotline transition 78; and then through the third slotline section 74.

The transitions between the microstrip input waveguides 80 and 82 and the slotline sections 70 and 72; the slotline sections 70 and 72 themselves; the coplanar waveguide section 76; and the coplanar waveguide-to-slotline transition 78, act as a transition from the dual input microstrip waveguides 80 and 82 to the balanced slotline output waveguide 74.

Any common mode energy existing in the differential input signals 52 and 54 is cancelled at the coplanar waveguide-to-slotline transition 78. A balanced field 56, lacking undesirable common mode (also called even mode) components and containing the desired odd mode components (also called differential or anti-phase components) is then output from the balun 20' via the third slotline section 74. Those skilled in the art will appreciate that the balun 20' may be operated in reverse, such that electromagnetic energy is input to the third slotline section 74, yielding two differential output signals along the microstrip sections 80 and 82.

Figure 4:
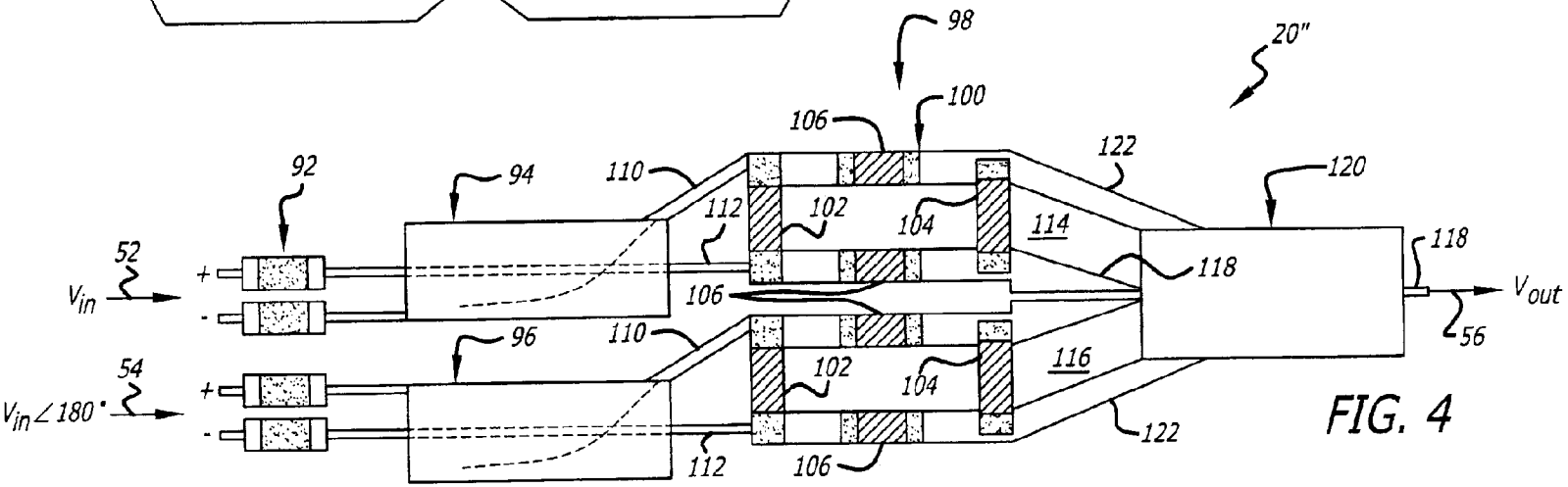
FIG. 4 is a more detailed diagram of a second alternative embodiment of the balun of FIG. 2.

FIG. 4 is a more detailed diagram of a second alternative embodiment 20" of the balun 20 of FIG. 2. The balun 20" includes, from left to right, a set of input DC-blocking capacitors 92, first and second input coaxial cables 94 and 96, respectively, for accommodating differential input signals, a waveguide transition section 98, and a single output coaxial cable 120.

The waveguide transition section 98 includes a load-matching resistor bridge 100. The resistor network, i.e., resistor bridge 100 includes two input resistors 102, each positioned between outer conductors 110 and center conductors 112 of the input coaxial cables 94 and 96. Output resistors 104 are connected between the inner conductor 118 and the outer conductor 122 of the output coaxial cable 120. Four center resistors 106 are connected between terminals of the input resistors 102 and the output resistors 104.

The waveguide transition section 98 is configured so that a coplanar waveguide section is formed from a first slotline 114 and a second slotline 116. The first slotline 114 is formed between the outer conductor 122 and the center conductor 118 of the output coaxial cable 122 and between the outer conductor 110 and inner conductor 112 of the first input coaxial cable 94. Similarly, the second slotline 116 is formed between the between the outer conductor 122 and the inner conductor 118 of the of the output coaxial cable between the outer conductor 110 and inner conductor 112 of the second input coaxial cable 96. The waveguide transition section 98 may be considered a dual coax-to-coplanar waveguide-to-single coax transition.

In operation, differential input signals 52 and 54 are input to the first input coaxial cable 94 and the second coaxial cable 96, respectively, via the optional DC blocking capacitors 92, which remove Direct Current (DC) offsets from the input signals 52 and 54. The differential signals 52 and 54 then pass to the waveguide transition section 98, which employs the resistor bridge 100 to facilitate load matching and maximum power transfer through the balun 98. Common mode electromagnetic energy is rejected at the transition between the slotlines 114 and 116 and the output coaxial cable 120. Since the output coaxial cable is a dual conductor transmission line, it does not support common mode energy. Consequently, the output signal 56 lacks the undesired even mode component that may exist in the differential input signals 52 and 54. The resistor bridge 100 also helps to absorb any reflected common mode energy.

Those skilled in the art will appreciate that the exact dimensions of the various waveguides 94, 96, 114, 116, 120, components of the balun 20", and the resistor values and sizes of the resistors 102–106 of the resistor bridge 100, are application-specific. These dimensions and values may be determined by one skilled in the art to meet the needs of a given application without undue experimentation.

The alternative balun 20" has been constructed and tested for a particular application by the inventor and has shown to exhibit effective broadband frequency performance. In general, the baluns 20, 20', and 20" of the present invention are compact, broadband baluns that exhibit a frequency-independent anti-phase response. They are suitable for use in various applications, including DDS applications, power dividers, broadband amplitude trackers, and so on.

Thus, the present invention has been described herein with reference to a particular embodiment for a particular application. Those having ordinary skill in the art and access to the present teachings will recognize additional modifications, applications, and embodiments within the scope thereof.

It is therefore intended by the appended claims to cover any and all such applications, modifications and embodiments within the scope of the present invention.

Accordingly,

What is claimed is:

1. A space-efficient broadband balun comprising:

first means for receiving an input signal having an undesirable component, wherein said first means includes first and second coaxial waveguides and wherein said undesirable component is a common mode component; and second means for rejecting said undesirable component via a waveguide transition, wherein said waveguide transition includes a dual coax-to-coplanar waveguide-to-single coax transition;

wherein said waveguide transition includes a resistor network to facilitate load matching and attenuate back-reflected common mode energy.

2. The balun of claim 1 wherein said undesirable component is a common mode component.

3. The balun of claim 1 wherein said first means includes an input microstrip waveguide.

4. The balun of claim 3 wherein said waveguide transition is a single microstrip-to-slotline transition.

5. The balun of claim 4 wherein said single microstrip-to-slotline transition includes said input microstrip waveguide positioned to cross over a slotline in a ground plane of said microstrip waveguide.

6. The balun of claim 5 wherein said slotline is terminated at a first end via a wedge in said ground plane, and wherein a second end of said slotline provides an output of said balun.

7. The balun of claim 6 wherein said input signal includes a first input signal and a second input signal, which are input at opposite ends of said input microstrip waveguide, said first input signal and said second input signal having a desired differential mode component and an undesired common mode component.

8. The balun of claim 1 wherein said first means includes first and second microstrip waveguides.

9. The balun of claim 8 wherein said input signal includes a first input signal travelling on said first microstrip waveguide and a second input signal travelling on said second microstrip waveguide, and wherein desired signal components of said first and second signal are approximately 180 degrees out of phase.

10. The balun of claim 9 wherein said first input signal and said second input signal are high-frequency pulse-like signals.

11. The balun of claim 10 wherein said waveguide transition includes a transition from said first and second microstrip waveguides to a slotline output waveguide, said slotline output waveguide rejecting common mode energy and passing differential mode energy corresponding to said desired signal component.

12. The balun of claim 11 wherein said transition includes a fist transition from said first microstrip line to a first slotline section and a second transition from said second microstrip line and a second slotline section.

13. The balun of claim 12 wherein said transition further includes a coplanar waveguide section fed via said first slotline section and said second slotline section.

14. The balun of claim 13 wherein said transition further includes a transition from said coplanar waveguide section to said slotline output waveguide.

15. The balun of claim 14 wherein said first, second, and third slotline sections and said coplanar waveguide section are implemented in a ground plane associated with said first and second microstrip waveguides.

* * * * *